US006210152B1

(12) United States Patent
Haffner et al.

(10) Patent No.: US 6,210,152 B1
(45) Date of Patent: Apr. 3, 2001

(54) BURNER FOR A HEAT GENERATOR AND METHOD FOR OPERATING THE SAME

(75) Inventors: Ken Haffner; Matthias Hobel, both of Baden; Thomas Ruck, Rekingen, all of (CH)

(73) Assignee: ABB Research Ltd., Zurich (CH)

( * ) Notice: Subject to any disclaimer, the term of this patent is extended or adjusted under 35 U.S.C. 154(b) by 0 days.

(21) Appl. No.: 09/379,470

(22) Filed: Aug. 24, 1999

(30) Foreign Application Priority Data

Sep. 16, 1998 (EP) ..... 98810922

(51) Int. Cl.[7] ..... F23D 14/82

(52) U.S. Cl. ..... 431/12; 431/22; 431/42; 431/281

(58) Field of Search ..... 431/12, 22, 42, 431/258, 281, 284, 285, 346, 354; 60/737, 39.826

(56) References Cited

U.S. PATENT DOCUMENTS

| | | | | |
|---|---|---|---|---|
| 4,301,656 | * | 11/1981 | Stettler | 60/737 |
| 5,660,044 | * | 8/1997 | Bonciani et al. | 60/737 |
| 5,735,687 | * | 4/1998 | Knöpfel et al. | 431/354 |
| 5,857,320 | * | 1/1999 | Amos et al. | 60/737 |
| 5,954,495 | * | 9/1999 | Knöpfel et al. | 431/285 |
| 5,978,525 | * | 11/1999 | Shu et al. | 431/22 |

FOREIGN PATENT DOCUMENTS

| | | |
|---|---|---|
| 19547913A1 | 6/1997 | (DE) . |
| 0146278A2 | 6/1985 | (EP) . |
| 0321809B1 | 5/1991 | (EP) . |
| 0670456A1 | 9/1995 | (EP) . |
| 0797051A2 | 9/1997 | (EP) . |
| 0816760A1 | 1/1998 | (EP) . |
| 96/00364 | 1/1996 | (WO) . |
| 98/21450 | 5/1998 | (WO) . |

* cited by examiner

*Primary Examiner*—Ira S. Lazarus
*Assistant Examiner*—Sara Clarke
(74) *Attorney, Agent, or Firm*—Burns, Doane, Swecker & Mathis, L.L.P.

(57) ABSTRACT

In a burner for operating a combustor, the former consists essentially of a rotation generator (100), a transition piece following the rotation generator, and a mixing pipe following this transition piece. Transition piece and mixing pipe form the mixing section (220) of the burner and are located upstream from a combustion chamber (30). In the lower part of the mixing pipe is located a pilot burner system (300) which creates, among other things, a stabilization of the flame front, in particular in the transient load ranges, while minimizing pollutant emissions. A sensor (400) installed in the burner detects a flashback of the flame (80), whereupon the fuel quantity of this flame is at least temporarily reduced and at the same time the fuel quantity for the pilot burner is increased in such a way that the total fuel quantity and thus the turbine output remains constant. This measure prevents a destruction of the burner.

13 Claims, 8 Drawing Sheets

100
115
201
10
200
60
220
40
20
21
301
303
311
300
302
304
308
305
307
310
306
309
50

BURNER FOR A HEAT GENERATOR AND METHOD FOR OPERATING THE SAME

FIELD OF TECHNOLOGY

The invention on hand relates to a burner for a heat exchanger according to the preamble of claim 1. It also relates to a method for operating such a burner.

STATE OF THE ART

Usually, burners of gas turbines are operated in premix mode. Such premix burners are known from EP-B1-0 321 809 and DE-195 47 913.0. By using upstream fuel injection in such premix burners, the fuel is premixed with the air before the combustion takes place. This provides an explosive mixture for the further combustion inside the burner. In general, it can be noted that such new generation burners offer numerous advantages, for example, a stable flame position, lower pollutant emissions (CO, UHC, NOx), minimal pulsations, complete burnout, a larger operating range, good cross-ignition between the various burners, in particular when creating graduated loads, during which case the burners are operated independently from each other, an adaptation of the flame to the corresponding combustor geometry, a compact design, an improved mixing of the flow media, an improved "pattern factor" of temperature distribution in the combustor, i.e., a balanced temperature profile of the combustor flow.

If, however, unforeseen malfunctions occur during operation, this may result in flame instability. Once the flashed-back flame is able to stabilize inside the burner, it burns as a diffusion flame with a very high temperature, at about 1900° C. Within a short time, ranging from 10 to max. 30 seconds, the burner overheats and is destroyed. In any case, the gas turbine must be stopped, inspected, and repaired, resulting in tremendous costs. It was found that, in particular, in prototype gas turbines with new combustion technology or combustion of hydrogen-containing fuels (MBt or LBt gasses) a high risk exists in this regard.

DESCRIPTION OF THE INVENTION

The invention attempts to solve this problem. The invention, as characterized in the claims, is based on the objective of proposing measures for a burner and a process of the initially mentioned type that would maximize flame stability in the burner.

According to the invention it is proposed to provide the burners with a compact, contactless flame monitor in a suitable place.

The essential advantages of the invention are that the sensor installed in the burner reports a flashback of the flame. Then the premix fuel mixture is reduced, and the pilot fuel quantity is simultaneously increased, so that the total fuel quantity, and therefore the turbine output, remains constant. Because of the reduction, i.e., of the premix fuel quantity, the flashback flame can no longer stabilize in the burner; it is inevitably flushed out of the burner. This makes it possible to prevent a destruction of the burner.

Such a sensor or flame monitor can be realized with high-temperature-resistant glass fibers. These fibers are arranged so that their monitoring field covers the areas at risk, but not the pilot and premix flame burning normally. The UV portion (about 300–330 nm) of the radiation measured by the sensor undergoes a spectral analysis with suitable filters. A flashback in the burner can be detected within a matter of milliseconds via the ratio of the intensity at various wavelengths. If the combustor consists of a number of burners, it is possible to determine with suitable data acquisition in which burner the flame flashback has occurred, and suitable measures for eliminating the causes can be taken.

Advantageous and useful further developments of the solution according to the invention are characterized in the remaining claims.

The following is a more detailed discussion of the exemplary embodiments of the invention in reference to the drawings. Any characteristics not essential for the direct understanding of the invention have been ignored. Identical elements have been marked in the various figures with the same reference symbols. The flow direction of the media is indicated with arrows.

METHODS FOR EXECUTING THE INVENTION, COMMERCIAL USABILITY

Figure 1:
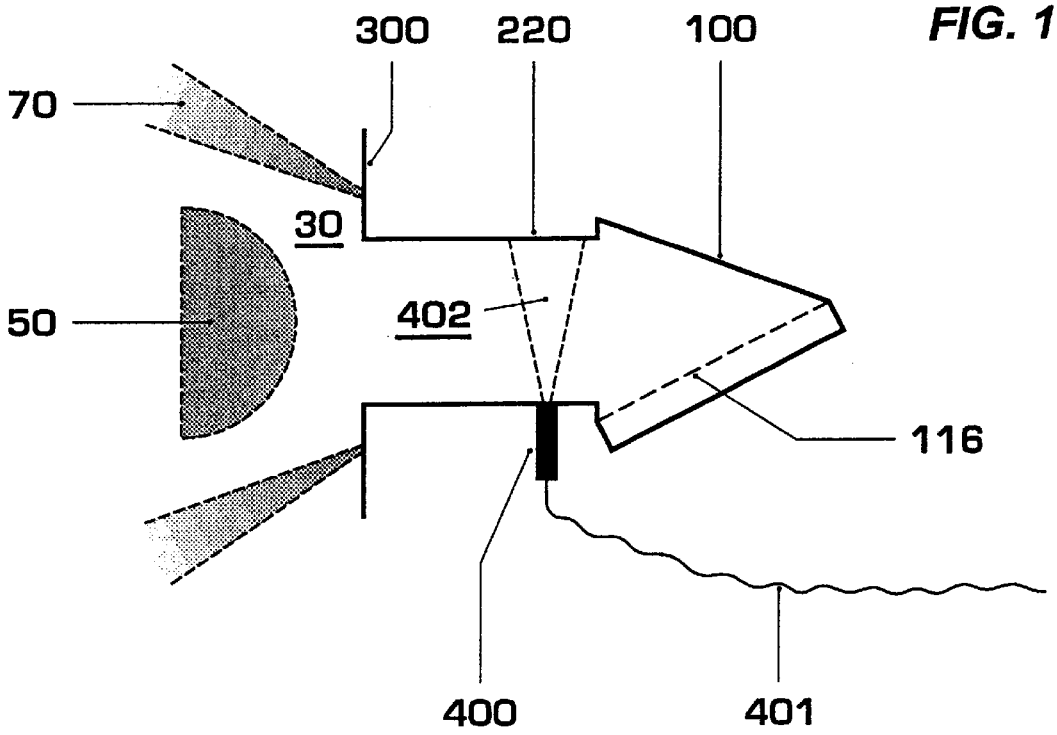
FIG. 1 shows a schematic view of a burner with integrated sensor.
Figure 2:
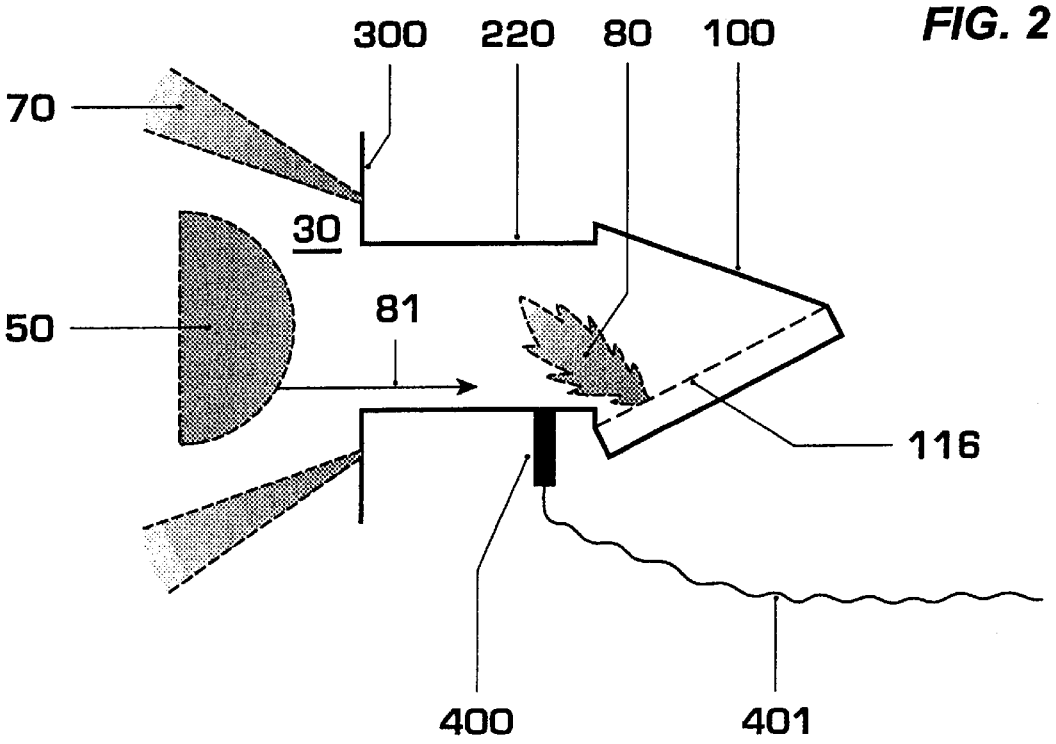
FIG. 2 shows a burner after flashback and with subsequent stabilization of the flame in the burner.

FIG. 1 shows a schematic overview of a premix burner, whereby the design of such a burner has been described in detail in FIGS. 4–11. Principally, this premix burner consists of a rotation generator 100, of a mixing section 220 following this rotation generator, whereby a system of pilot burners 300 with corresponding pilot flames 70 act in the combustor 30 following the mixing section 220. In connection with FIG. 2, this FIG. 1 only strives to explain how the flashback 81 of the premix flame 50 which is shown here by means of the flowback bubble, is detected by sensors 400, and how remedial measures are initiated immediately. In the process, it is always observed that a back-ignition from the combustor 30 to the fuel injectors 116 takes place. A stabilization of this back-ignited flame 80 in the area of the fuel injectors 116 then can no longer be avoided, whereby in this case a diffusion flame with very high temperatures of approximately 1900° C. is created. This flame inevitably results in a destruction of the burner within a matter of a few seconds. At least one sensor 400 is placed immediately downstream from the fuel injectors 116 and is not supposed to monitor either the premix flame 50 nor the pilot flames 70, but only those areas at risk. Such a sensor 400 preferably consists of high-temperature-resistant glass fibers which are arranged in such a way that their scan angle 402 covers only those areas at risk. The radiation detected by the sensor is further transmitted 401 and undergoes a spectral analysis with suitable filters. A flashback in the burner can be detected within a matter of milliseconds via the ratio of the intensities at various wavelengths. A suitable data acquisition will make it possible to determine in which burner in the system the flame flashback has occurred, whereby specific measures for eliminating the cause then can be taken.

Figure 3:
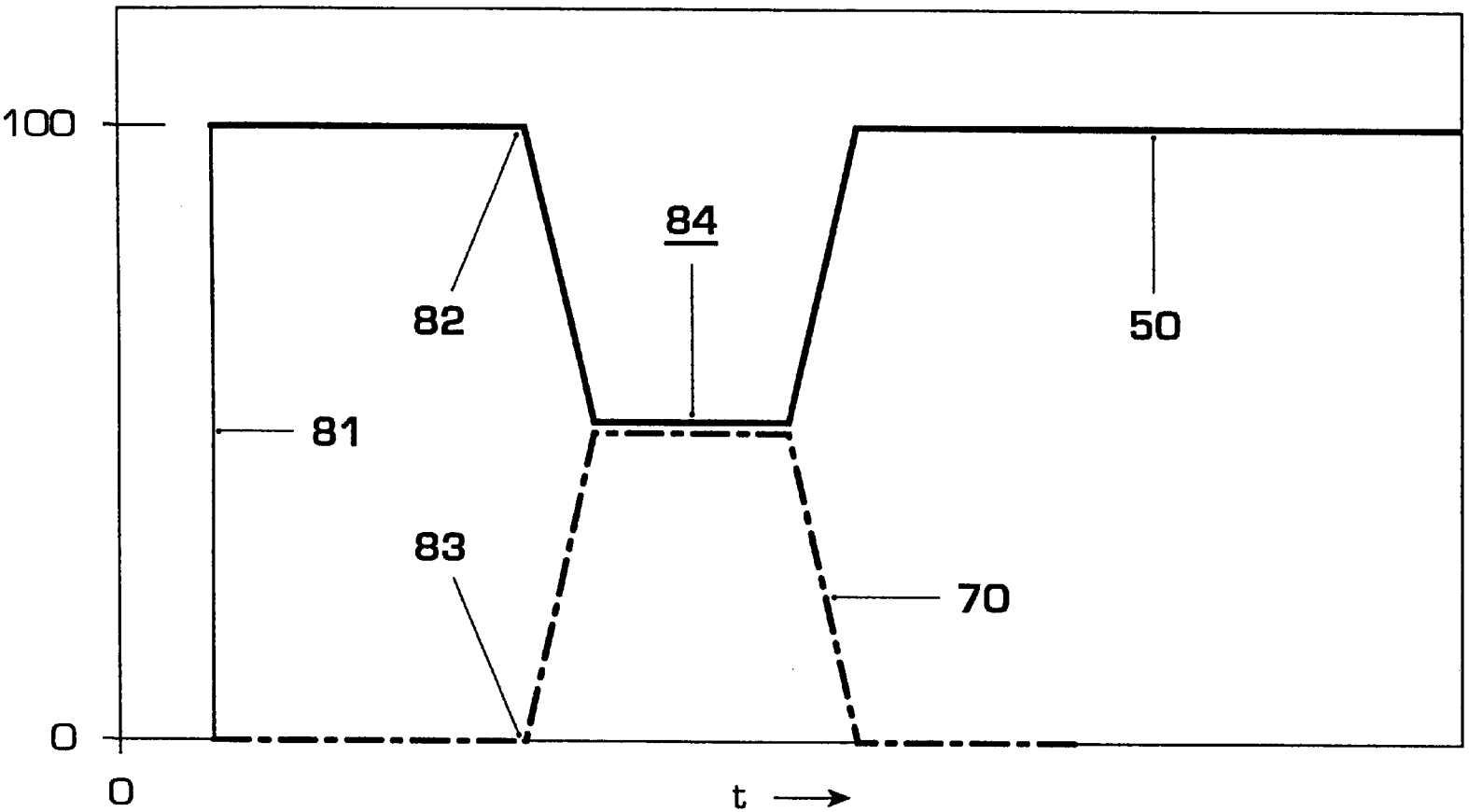
FIG. 3 shows a schematic fuel control sequence over time in case of a flame flashback.

FIG. 3 shows which measures are initiated following a flame flashback. When notified that a flashback 81 of the flame has taken place, a control 82 immediately manipulates the fuel quantity for the premix flame 50, which is immediately reduced according to certain criteria. At the same time, a second control 83 is actuated, which increases the fuel quantity for the pilot burner system 300, i.e., for the pilot flame 70. The objective of this counter-acting fuel supply is to keep the turbine output constant. By reducing the fuel quantity for the premix flame 50, the flashed-back flame is no longer able to stabilize in the burner, it is flushed out of the burner, so that the otherwise inevitable destruction of the burner is in this way safely avoided. FIG. 3 shows the qualitative sequence of the fuel control over time, whereby the flushing out 84 of the flashed-back flame takes place at the extreme points of this control.

This process for the direct detection of a flame flashback can be used for all premix burners based on a rotational flow, regardless of how the burner is geometrically constructed, and regardless of which way the rotational flow is created. In particular, this process can be used for the premix burner according to EP-B1-0 321 809, whereby this publication forms an integral part of this specification at hand.

Figures 4, 11:
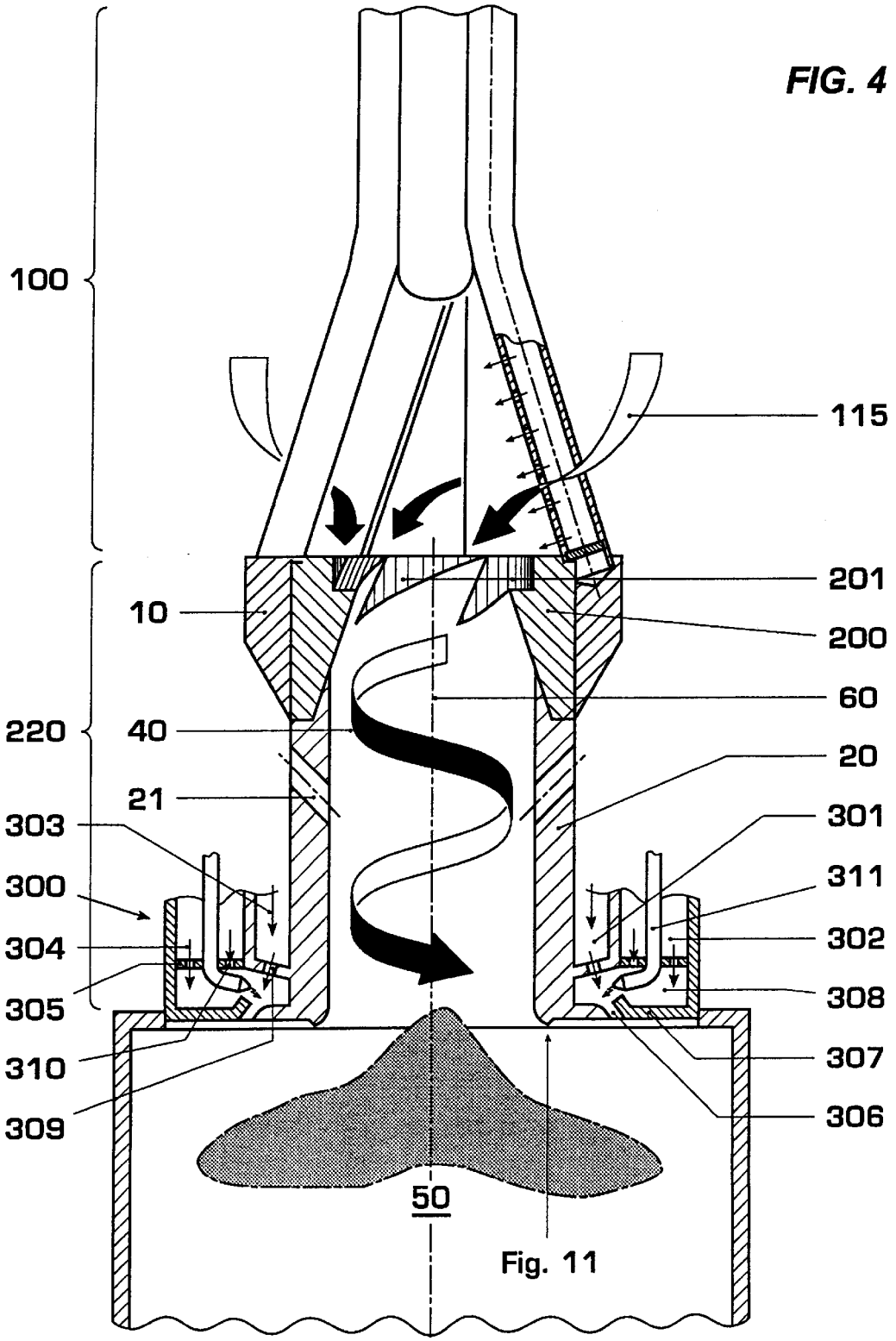
FIG. 4 shows an integral section through a burner designed as a premix burner with a mixing section downstream from a rotation generator and with pilot burners.

FIG. 4 shows the overall construction of a burner that can be operated with a rotational flow. Initially, a rotation generator 100 whose design is shown and explained in more detail in reference to the following FIGS. 5 through 8 is activated. This rotation generator 100 is a conical structure which is impacted repeatedly by a tangentially inflowing combustion air stream 115. The flow resulting from this is seamlessly fed with the help of a transition geometry located downstream from the rotation generator 100 into a transition piece 200 in such a way that no separation areas can occur there. The configuration of this transition geometry is described in more detail under FIG. 10. This transition piece 200 is extended on the flow-off side from the transition geometry with a mixing pipe 20, whereby both parts form the actual mixing section 220. Naturally, the mixing section 220 may also consist of a single piece, which means that the transition piece 200 and the mixing pipe 20 are then fused to form a single, contiguous structure, whereby the characteristics of each part are preserved. If the transition piece 200 and the mixing pipe 20 are constructed from two parts, these are connected with a bushing ring 10, whereby the same bushing ring 10 serves on the head side as an anchoring surface for the rotation generator 100. Such a bushing ring 10 also has the advantage of being able to use different mixing pipes. On the flow-off side of the mixing pipe 20, the actual combustion chamber 30 of a combustor, which in this case is only symbolized by a flame pipe, is located. The mixing section 220 essentially has the function of providing a defined section downstream from the rotation generator 100, in which a perfect premixing of fuels of various types can be achieved. This mixing section, i.e., here the mixing pipe 20, also permits a loss-free guidance of the flow, so that initially no flowback zone or flowback bubble is able to form even in active connection with the transition geometry, so that the mixing quality of all types of fuel can be influenced over the length of the mixing section 220. However, this mixing section 220 also has another characteristic, namely that the axial speed profile has a distinct maximum on the axis in this mixing section itself, so that a flashback of the flame from the combustor itself should actually be prevented. However, it is correct that with such a configuration this axial speeds decreases towards the wall. In order to prevent a flashback also in this area, the mixing pipe 20 is provided in the flow and peripheral direction with a number of regularly or irregularly distributed bores 21 that have different cross-sections and directions, through which bores a quantity of air flows into the inside of the mixing pipe 20 and induces an increase in the flow speed along the wall in the sense of forming a film. These bores 21 also can be designed so that, in addition, at least an effusion cooling occurs at the inside wall of the mixing pipe 20. Another possibility for increasing the speed of the mixture within the mixing tube 20 is by constricting the latter's flow cross-section downstream from the transition channels 201, which form the already mentioned transition geometry, so that the entire speed level inside the mixing pipe 20 is increased. In the figure, these bores 21 extend at an acute angle to the burner axis 60. The outlet of the transition channels 201 furthermore corresponds to the narrowest flow cross-section of the mixing pipe 20. Said transition channels 201 therefore bridge the respective cross-section differential without adversely affecting the formed flow.

If the selected measure causes an unacceptable loss of pressure when the pipe flow 40 is guided along the mixing pipe 20, this can be remedied by providing a diffuser (not shown in the figure) at the end of this mixing pipe. The end of the mixing pipe 20 is therefore followed by a combustor 30 (combustion chamber), whereby a change in cross-section that is a result of a burner front exists between the two flow cross-sections. Only here, a central flame front with a flowback zone that has the characteristics of a bodiless flame retention baffle in relation to the flame front forms. If, during operation, a marginal flow zone forms within this cross-section change in which turbulence separations are created because of the vacuum present there, this results in an increased ring stabilization of the flowback zone. In addition, it must not go unmentioned, that the formation of a stable flowback zone also requires a sufficiently high rotation value in a pipe. If such a rotation value is initially undesired, stable flowback zones can be created by introducing small air flows with strong rotations at the pipe end, for example through tangential openings. In the process it is hereby assumed that the air quantity required for this is about 5 to 20% of the total air quantity. In regard to the design of the burner front at the end of the mixing pipe 20 for stabilizing the flowback zone or flowback bubble, reference is made to the description for FIG. 8. Regarding the possibility of interfering with a flame flashback, reference is made to FIGS. 1 to 3.

A pilot burner system 300 is provided concentrically to the mixing pipe 20 in the area of the latter's outlet. This pilot burner system consists of an inner ring chamber 301 into which flows a fuel, preferably a gaseous fuel 303. Secondary to this inner ring chamber 301, a second ring chamber 302 is disposed, into which an air quantity 304 flows. Both ring chambers 301, 302 have individually designed through-openings in such a way that the individual media 303, 304 flow as a result of the function into a mutual, subsequent ring chamber 308. The passage of the gaseous fuel 303 from the ring chamber 301 into the subsequent ring chamber 308 is achieved by a number of peripherally located openings 309. The flow-through geometry of these openings 309 is such that the gaseous fuel 303 flows with a high mixing potential into the subsequent ring chamber 308. The other ring chamber 302 terminates in a perforated plate 305, whereby the bores 310 provided here are designed so that the air quantity 304 flowing through them results in an impact cooling on the bottom plate 307 of the subsequent ring chamber 308. This bottom plate has the function of a heat shield in relation to the caloric stress from the combustion chamber 30, so that this impact cooling must be extremely efficient here. After cooling has taken place, this air mixes inside this ring chamber 308 with the inflowing gaseous fuel 303 from the openings 309 of the upstream ring chamber 301, before this mixture then flows off into the combustion chamber 30 through a number of bores 306 on the combustion chamber side. The mixture flowing off here burns in the form of a premixed diffusion flame with minimized pollutant emissions and then forms for each bore 306 a pilot burner that acts into the combustion chamber 30 and which ensures a stable operation.

An ignition device 311 which in the subsequent ring chamber 308 brings about the ignition of the mixture formed there is conducted through the secondary ring chamber 302 through which an air stream flows. This conduction of the ignition device 311 on the one hand does not require any additional construction measures, and on the other hand this ignition device 311 is continuously cooled by the air 304 which flows there anyway. This is very important, because temperatures of approximately 1000° C. are reached at the tip of a glow igniter 2 pin. But since the operation proposed here requires only a low voltage, but high amps, the susceptibility of the ignition device to condensate water precipitation is eliminated. The arrangement of the glow igniter pin—whereby the use of a spark plug would also be possible—inside the burner results in a low thermal stress on the respective ignition device 311, so that no additional cooling is necessary and leaks are prevented.

Figure 5:
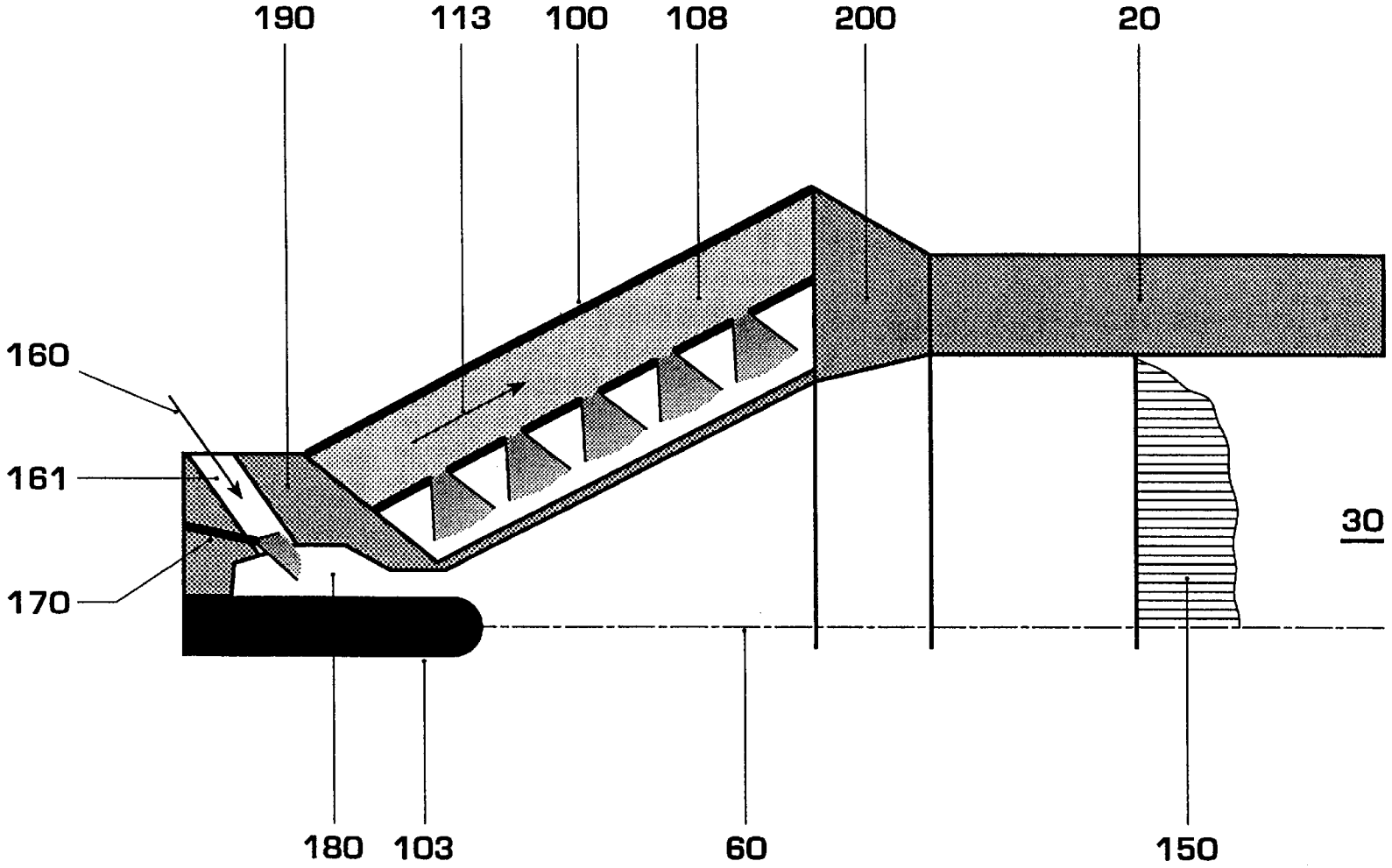
FIG. 5 shows a schematic portrayal of the burner according to FIG. 1 with disposition of the additional fuel injectors.

FIG. 5 shows a schematic view of the burner according to FIG. 4, whereby here reference is made specifically to the flow around a centrally located fuel nozzle 103 (see FIG. 6) and to the action of fuel injectors 170. The function of the remaining main components of the burner, i.e., rotation generator 100 and transition piece 200 are described in more detail below in reference to the figures. The fuel nozzle 103 is enclosed at a distance with a ring 190 into which a number of peripherally disposed bores 161 have been integrated, through which an air quantity 160 flows into an annular chamber 180 and there flows around the fuel lance. These bores 161 are placed so as to angle forward in such a way as to create an appropriate axial component on the burner axis 60. In active connection with these bores 161, additional fuel injectors 170 which add a certain quantity of a preferably gaseous fuel into the respective air quantity 160 have been provided so that a uniform fuel concentration 150 appears over the flow cross-section in the mixing pipe 20, as is symbolized in the figure. Exactly this uniform fuel concentration 150, in particular the strong concentration on the burner axis 60, ensures that a stabilization of the flame front occurs at the outlet of the burner, especially when using a central injection with liquid fuel, so that any occurrence of combustor pulsations are avoided.

Figure 6:
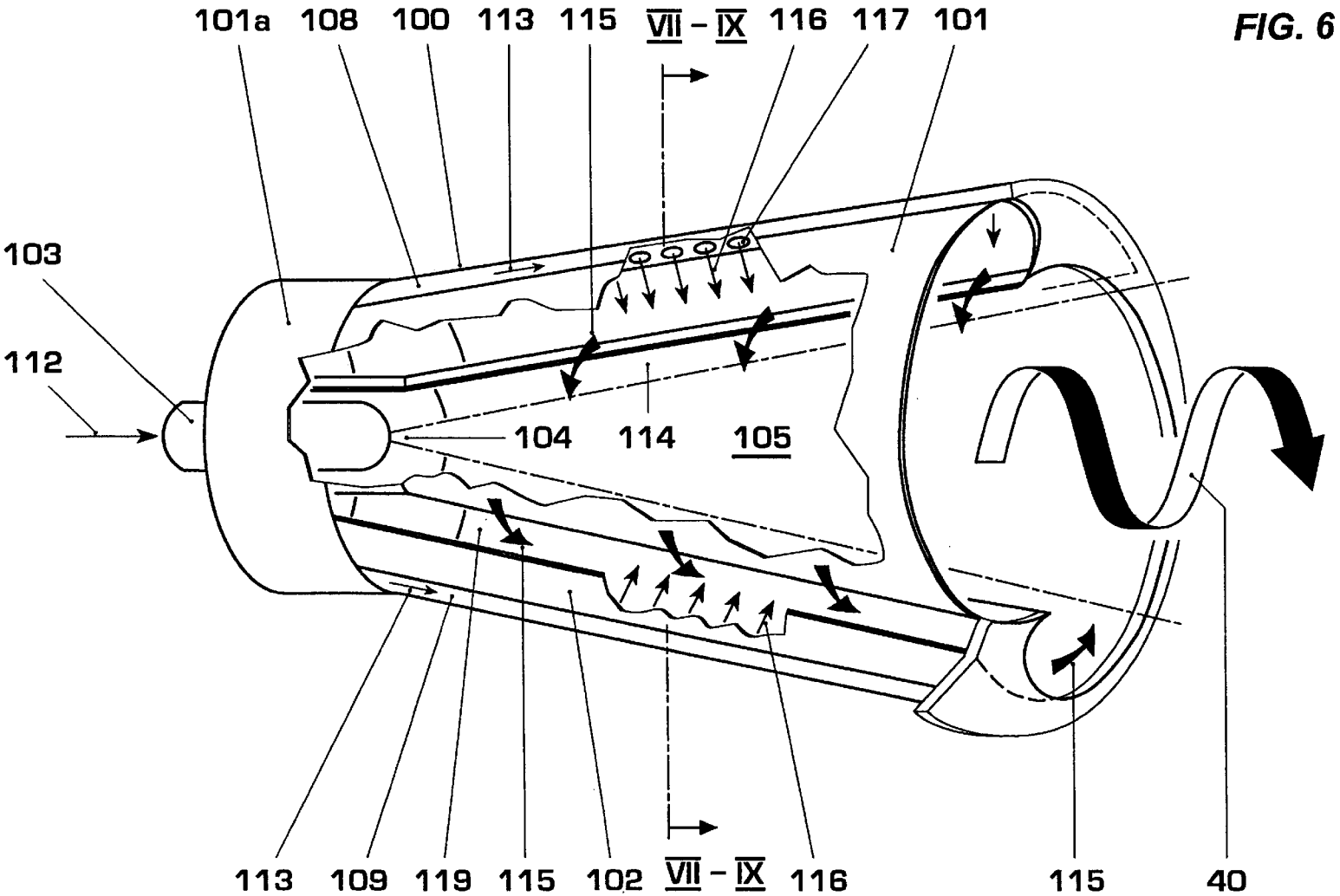
FIG. 6 shows a perspective drawing of a rotation generator consisting of several segments, sectioned accordingly.
Figure 7:
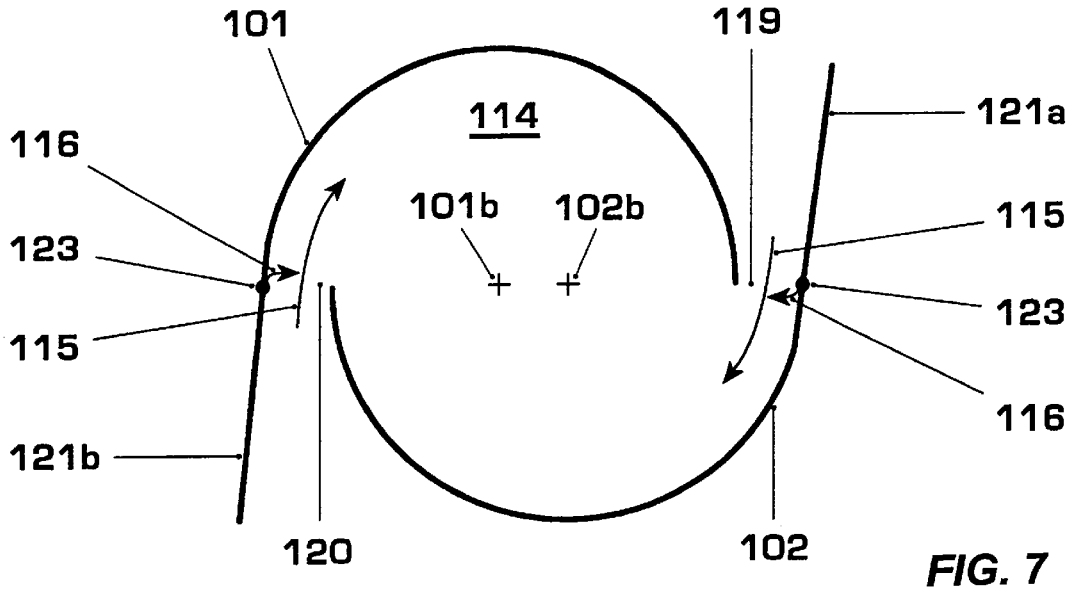
FIG. 7 shows a cross-section through a two-segment rotation generator.

In order to better comprehend the construction of the rotation generator 100, it is advantageous to explain FIG. 6 at least in conjunction with FIG. 7. If needed, the following text therefore will refer to the other figures when describing FIG. 6.

The first part of the burner according to FIG. 4 is formed by the rotation generator 100 in FIG. 6. The latter consists of two hollow, conical partial bodies 101, 102 which are stacked offset inside each other. The number of conical partial bodies natural may be greater than two, as can be seen in FIGS. 5 and 6. As will also be explained further below, this depends in each case on the operating mode of the burner overall. In certain operating configurations it is possible that a rotation generator consisting of a single spiral is provided. The offset of the respective center axis or longitudinal symmetry axes 101*b*, 102*b* (see FIG. 7) of the conical partial bodies 101, 102 relative to each other creates in each case in the adjoining wall, in a mirror-symmetrical arrangement, a tangential channel, i.e., an air inlet slit 119, 120 (see FIG. 7) through which the combustion air 115 flows into the interior of the rotation generator 100, i.e., into the conical cavity 114 of the same. The conical shape of the shown partial bodies 101, 102 in the flow direction has a specific fixed angle. Naturally, depending on the specific operating case, the partial bodies 101, 102 may have an increasing or decreasing conical angle in the flow direction, similar to a diffuser or confusor. The two last mentioned forms are not shown in the drawing since the expert will be able to understand them easily. The two conical partial bodies 101, 102 each have a cylindrical, annular starting part 101*a*. The fuel nozzle 103 already mentioned in reference to FIG. 2 which is preferably operated with a liquid fuel 112 is located in the area of this cylindrical starting part. The injection 104 of this fuel 112 coincides approximately with the narrowest cross-section of the conical cavity 114 formed by the conical partial bodies 101, 102. The injection capacity and the type of this fuel nozzle 103 depend on the specified parameters of the respective burner. The conical partial bodies 101, 102 also each have a fuel line 108, 109 which are located along the tangential air inlet slits 119, 120 and are provided with injection openings 117 through which preferably a gaseous fuel 113 is injected into the combustion air 115 flowing there, as is indicated symbolically by arrows 116. These fuel lines 108, 109 are arranged preferably not after the tangential inflow, prior to the entrance into the conical cavity 114, in order to obtain an optimum air/fuel mixture. The fuel 112 supplied through the fuel nozzle 103 is, as mentioned, usually a liquid fuel, whereby a mixture can be easily formed with another medium also, for example, with recycled flue gas. This fuel 112 is preferably injected at a very acute angle into the conical cavity 114. This means that after the fuel nozzle 103 a conical fuel spray forms, which is enclosed and reduced by the tangentially inflowing, rotational combustion air 115. The concentration of the injected fuel 112 is then constantly reduced in axial direction by the inflowing combustion air 115, resulting in a mixing that approaches an evaporation. If a gaseous fuel 113 is added via the opening nozzles 117, the fuel/air mixture is formed directly at the end of the air inlet slits 119, 120. If the combustion air 115 is additionally preheated or enriched, for example, with recycled flue gas or exhaust gas, this greatly supports the evaporation of the liquid fuel 112, before this mixture flows into the next stage, here into the transition piece 200 (see FIGS. 4 and 10). The same concepts also apply if liquid fuels are supplied via lines 108, 109. When designing the conical partial bodies 101, 102 in regard to the conical angle and the width of the tangential air inlet slits 119, 120, narrow limits must actually be kept, so that the desired flow field of the combustion air 115 is able to form at the outlet of the rotation generator 100. In general, it can be said that a reduction of the tangential air inlet slits 119, 120 promotes the faster formation of a flowback zone already in the area of the rotation generator. The axial speed within the rotation generator 100 can be increased or stabilized with an addition of an air quantity that is described in more detail in reference to FIG. 2 (No. 160). A corresponding rotation generation in active connection with the subsequent transition piece 200 (FIGS. 4 and 10) prevents the formation of flow separations within the mixing pipe following the rotation generator 100. The construction of the rotation generator 100 is also very suitable for changing the size of the tangential air inlet slits 119, 120, so that a relatively large operating bandwidth can be covered without changing the design length of the rotation generator 100. The partial bodies 101, 102 naturally can also be moved relative to each other on a different plane, whereby even an overlapping of them is possible. It is also possible to stack the partial bodies 101, 102 spiral-like inside each other by a counter-rotating movement. This makes it possible to change the shape, size, and configuration of the tangential air inlet slits 119, 120 as desired, so that the rotation generator 100 can be universally used without changing its design length.

FIG. 7, among other things, shows the geometric configuration of optionally provided baffle plates 121*a*, 121*b*. They have a flow introduction function and extend, depending on their length, the respective end of the conical partial bodies 101, 102 in the flow direction relative to the combustion air 115. The channeling of the combustion air 115 into the conical cavity 114 can be optimized by opening or closing the baffle plates 121*a*, 121*b* around a pivoting point 123 placed in the area of the entrance of this channel into the conical cavity 114; this is, in particular, necessary if the original slit size of the tangential air inlet slits 119, 120 should be changed dynamically, for example, in order to change the speed of the combustion air 115. Naturally, these dynamic measures can also be provided statically, in that baffle plates, as required, form a fixed part with the conical partial bodies 101, 102.

Figure 8:
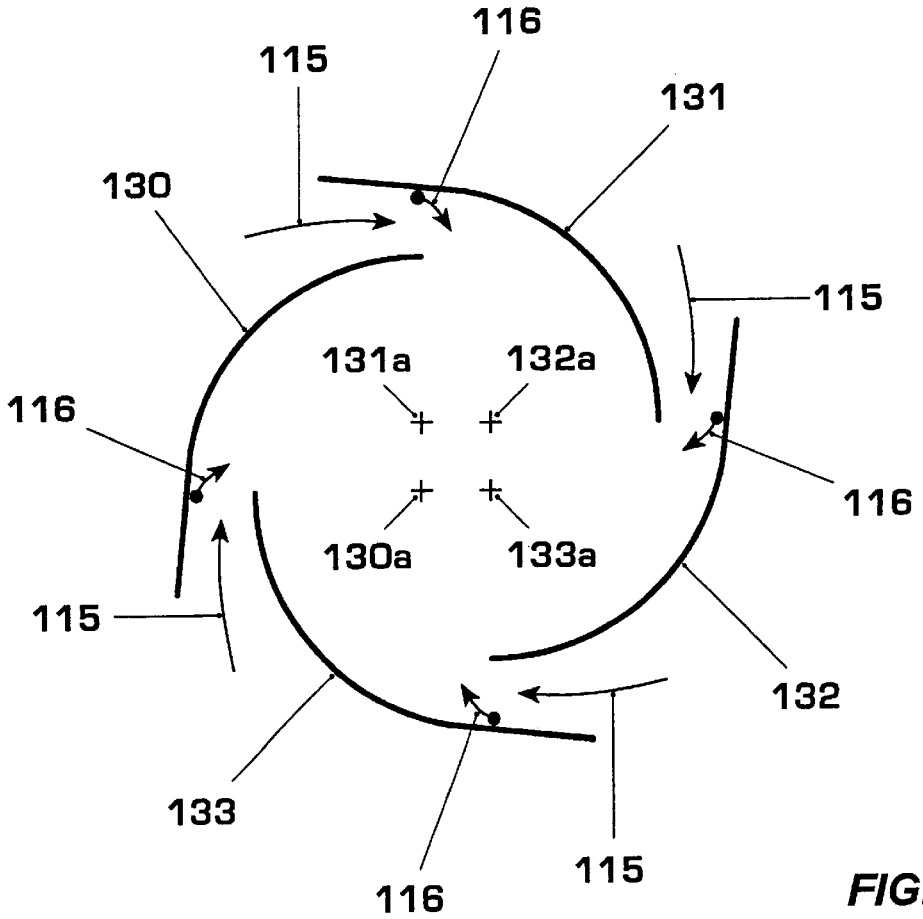
FIG. 8 shows a cross-section through a four-segment rotation generator.

Compared to FIG. 4, FIG. 8 shows that the rotation generator 100 is now constructed of four partial bodies 130, 131, 132, 133. The associated longitudinal symmetry axes for each partial body are designated with the letter "a." Regarding this configuration, it can be said that as a result of the lower rotation intensity generated with it and in connection with a correspondingly greater slit width, it is ideally suited to prevent the bursting of the turbulence flow on the outlet side of the rotation generator in the mixing pipe, so that the mixing pipe is able to optimally fulfill its intended role.

Figure 9:
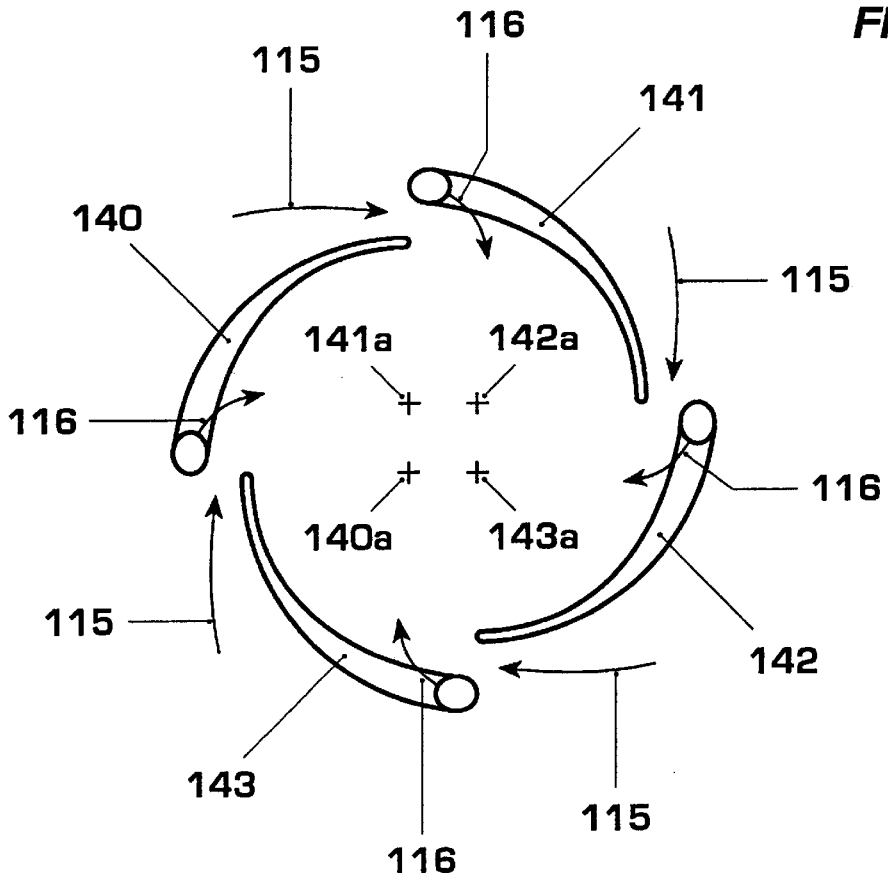
FIG. 9 shows a view through a rotation generator whose segments are profiled in blade-shape.

Compared to FIG. 8, the difference in FIG. 9 is that here the partial bodies 140, 141, 142, 143 have a blade profile shape which has been provided to create a certain flow. Other than that, the operating mode of the rotation generator has remained the same. The admixture of the fuel 116 into the combustion air stream 115 is accomplished from the inside of the blade profiles, i.e., the fuel line 108 is now integrated into the individual blades. The longitudinal symmetry axes for the individual partial bodies are also designated with the letter "a" here.

Figure 10:
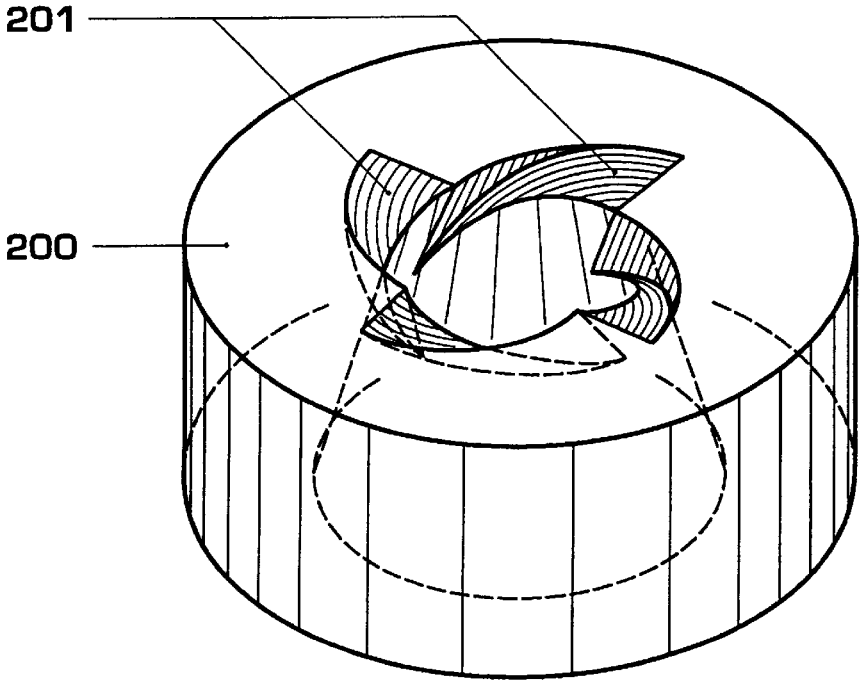
FIG. 10 shows a variation of the transition geometry between rotation generator and mixing section; and, FIG. 11 shows a tear-off edge for the spatial stabilization of the flowback zone.
Figure 11:
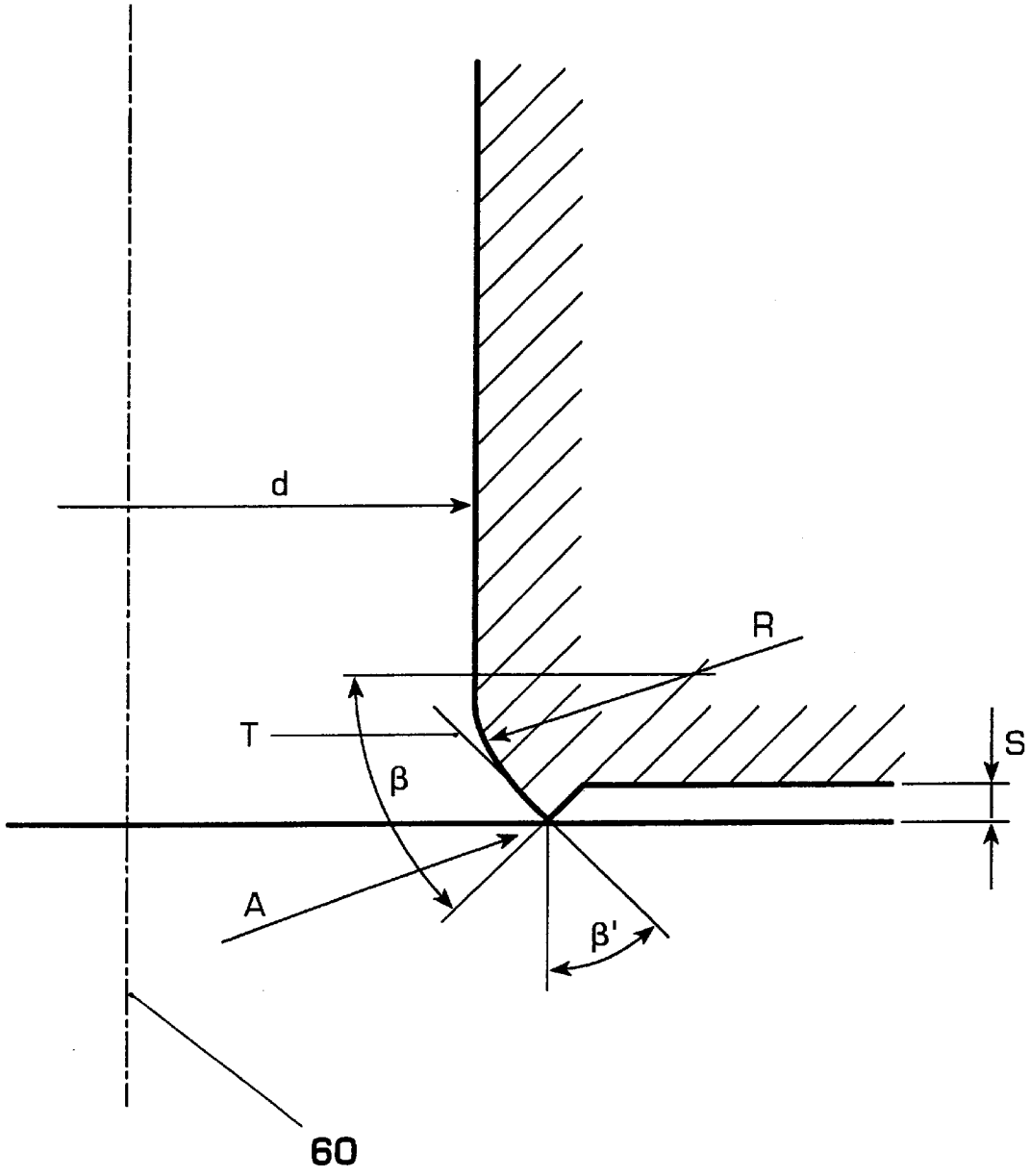

FIG. 10 shows a three-dimensional view of the transition piece 200. The transition geometry is constructed for a rotation generator 100 with four partial bodies, corresponding to FIG. 5 or 6. Accordingly, the transition geometry has four transition channels 201 as a natural extension of the partial bodies acting upstream, so that the conical quarter surface of said partial bodies is extended until it intersects the wall of the mixing pipe. The same concepts also apply if the rotation generator has been constructed according to a different principle than the one described in reference to FIG. 4. The surface of the individual transition channels 201 that extends downward in the flow direction has a spiral shape in the flow direction that describes a sickle-shaped progression, corresponding to the fact that the flow cross-section of the transition piece 200 is in this case conically extended in the flow direction. The rotation angle of the transition channels 201 in the flow direction has been chosen so that the pipe flow has then a sufficiently long section available before the change in diameter at the combustor inlet to achieve a perfect premixing with the injected fuel. The above mentioned measures furthermore increase the axial direction at the mixing pipe wall downstream from the rotation generator. The transition geometry and the measures in the area of the mixing pipe bring about a clear increase in the axial speed profile towards the center of the mixing pipe, decisively counteracting the risk of a premature ignition.

FIG. 11 shows the already discussed tear-off edge formed at the burner outlet. The flow cross-section of the pipe 20 in this area has the transition radius R whose size depends principally on the flow inside the pipe 20. This radius R is selected so that the flow closely follows the wall and in this way causes the rotation value to greatly increase. Quantitatively, the size of the radius R can be defined so that it is greater than 10% of the inside diameter d of the pipe 20. Compared to the flow without a radius, the flowback bubble now increases enormously. This radius R extends up to the outlet plane of the pipe 20, whereby the angle β between beginning and end of the curvature is less than 90°. The tear-off edge A extends along one leg of the angle β into the interior of the pipe 20 and in this way forms a tear-off stage S relative to the front point of the tear-off edge A whose depth is greater than 3 mm. Naturally, the edge which here extends parallel to the outlet plane of the pipe 20 can now be returned to the stage of the outlet plane with a curved progression. The angle β' between the tangent of the tear-off edge A and the vertical to the exit plane of the pipe 20 is identical to the angle β. The advantages of this design of the tear-off edge are found in EP-0 780 629 A2 in section "Description of the Invention." A further design of the tear-off edge for the same purpose can be achieved with torus-like notches on the combustor side. This publication, including its protected scope in regard to the tear-off edge, is an integral part of this specification.

What is claimed is:

1. A method for operating a burner comprising the steps of:

providing a burner for a heat generator comprising a rotation generator for generating a rotational flow of combustion air and including at least one fuel injector, and at least one sensor located in a downstream air flow direction from the at least one fuel injector for detecting a flashback of a premix flame formed in a combustion chamber and initiating a fuel regulation, detecting a flashback of the premix flame by the sensor, at least temporarily reducing a fuel quantity supplying the premix flame when the flashback of the flame is detected, and simultaneously increasing a fuel quantity supplying a pilot burner system of the burner such that a total fuel quantity and an output of the heat generator remain constant.

2. The method as claimed in claim 1, wherein the at least one fuel injector injects at least one fuel into the flow of combustion air for formation of a premix flame; and wherein the burner further comprises a mixing section located in the downstream air flow direction from the rotation generator and including a first section and a mixing pipe, the first section including a plurality of transition channels for transferring the flow formed in the rotation generator into the mixing pipe located downstream from the transition channels, the mixing pipe including a pilot burner system in fluid communication with the combustion chamber, and the combustion chamber being located in a downstream flow direction from the mixing pipe.

3. The method as claimed in claim 2, wherein the rotation generator further includes at least two hollow, conical partial bodies which are nested inside each other in the downstream air flow direction, wherein the partial bodies have respective longitudinal symmetry axes which extend offset relative to each other such that adjacent walls of the partial bodies form longitudinally extending tangential channels for the flow of combustion air, and in an interior chamber formed by the partial bodies at least one fuel nozzle is arranged.

4. The method as claimed in claim 3, wherein additional fuel injectors are provided along the longitudinal extent of the tangential channels.

5. The method as claimed in claim 4, wherein the partial bodies have a cross-section with a blade-shaped profile.

6. The method as claimed in claim 2, wherein the pilot burner system includes a cooling means and at least one ignition device.

7. The method as claimed in claim 2, wherein the pilot burner system includes at least two media-carrying chambers and a subsequent chamber, a media from the at least two media-carrying chambers is capable of being mixed in the subsequent chamber and the subsequent chamber including means for forming a pilot flame in the combustion chamber from the mixture of the two media.

8. The method as claimed in claim 7, wherein the at least two media-carrying chambers are constructed in a ring-shape, through a first ring chamber a gaseous fuel flows, and through a second ring chamber an air quantity flows, in the second ring chamber a means is integrated through which the air flowing therethrough brings about an impact cooling on a heat shield located on an end side of the pilot burner system and an ignition device extends through the second ring chamber.

9. The method as claimed in claim 8, wherein the impact cooling is performed with a perforated plate forming a bottom of the second ring chamber.

10. The method as claimed in claim 2, wherein a burner front portion of the mixing pipe is constructed with a tear-off edge facing the combustion chamber.

11. The method as claimed in claim 2, wherein a number of transition channels in the mixing section corresponds to a number of partial flows created by the rotation generator.

12. The method as claimed in claim 2, wherein the mixing pipe located downstream of the transition channels is provided in the air flow direction and a peripheral direction with openings for injecting an air stream into the interior of the mixing pipe.

13. The method as claimed in claim 2, wherein between the mixing section and the combustion chamber there is a change in cross-section between the cross-section of the mixing section and the cross-section of the combustion space, the change in cross-section induces the initial flow cross-section of the combustion chamber and a premix flame with a flowback zone is formed in an area of the change in cross-section.

* * * * *